US005149289A

United States Patent [19]

Edwards et al.

[11] Patent Number: 5,149,289

[45] Date of Patent: Sep. 22, 1992

[54] TRANSFORMABLE DOLL

[75] Inventors: Patricia Edwards, 1608 Shafter, San Angelo, Tex. 76901; Jody Armstrong, San Angelo, Tex.

[73] Assignee: Patricia Edwards, San Angelo, Tex.

[21] Appl. No.: 654,014

[22] Filed: Feb. 12, 1991

[51] Int. Cl.[5] ..... A63H 3/12

[52] U.S. Cl. ..... 446/321; 446/268; 446/279

[58] Field of Search ..... 446/321, 268, 99, 97, 446/369, 279, 101

[56] References Cited

U.S. PATENT DOCUMENTS

| | | | |
|---|---|---|---|
| 582,625 | 5/1897 | Emery | 446/321 |
| 1,640,260 | 8/1927 | Vogel | 446/268 |
| 1,966,986 | 7/1934 | Martin | 446/321 |
| 3,421,257 | 1/1969 | Ostrander, Jr. | 446/279 |
| 3,961,439 | 6/1976 | Moustakas | 446/321 X |

FOREIGN PATENT DOCUMENTS

| | | | |
|---|---|---|---|
| 619702 | 5/1961 | Canada | 446/321 |
| 280867 | 5/1952 | Switzerland | 446/321 |

*Primary Examiner*—Mickey Yu
*Attorney, Agent, or Firm*—Harold E. Meier

[57] ABSTRACT

The invention includes a doll transformable between two characters or persona. The doll includes interconnected upper body portions of each character or persona. A stand portraying the lower body portion of at least one of the characters or persona receives the upper body portion not in use. Assembly of the stand with one of the upper body portions extending therefrom gives the illusion of a complete character or persona.

12 Claims, 4 Drawing Sheets

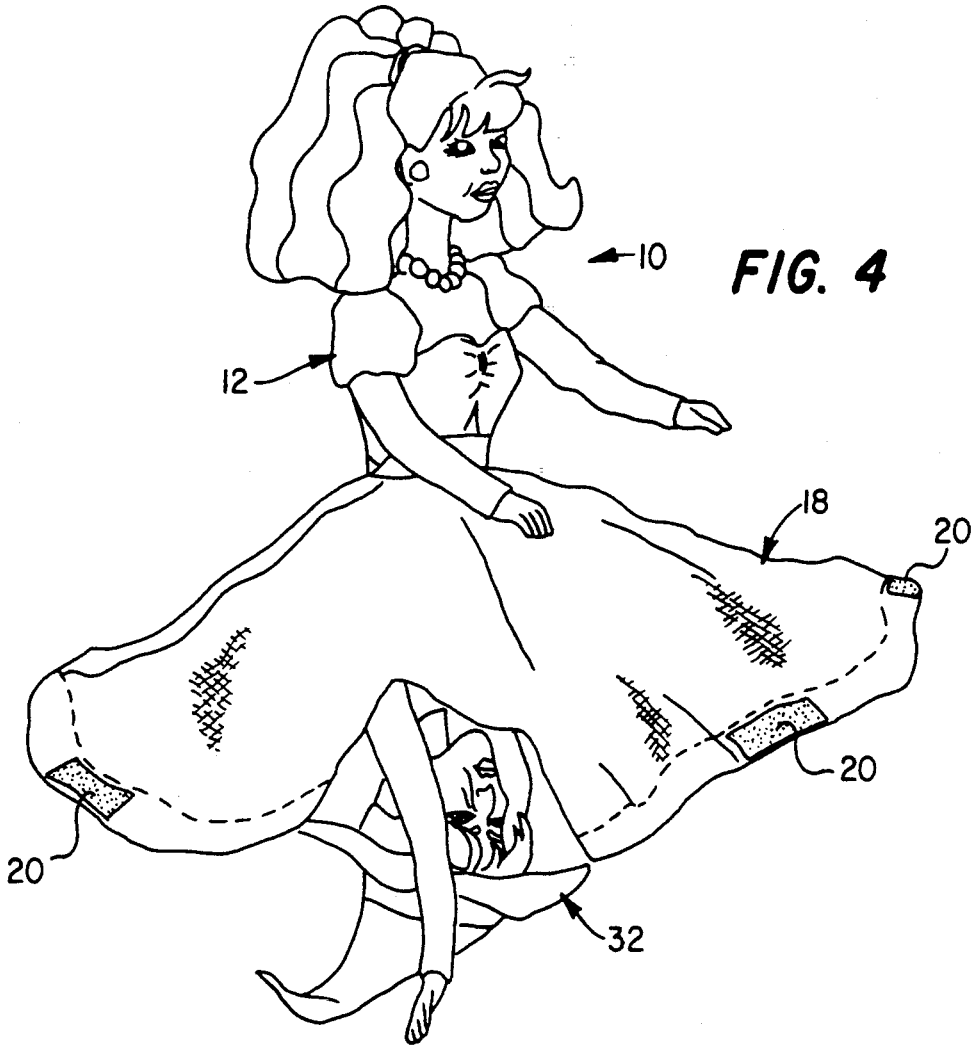
FIG. 4
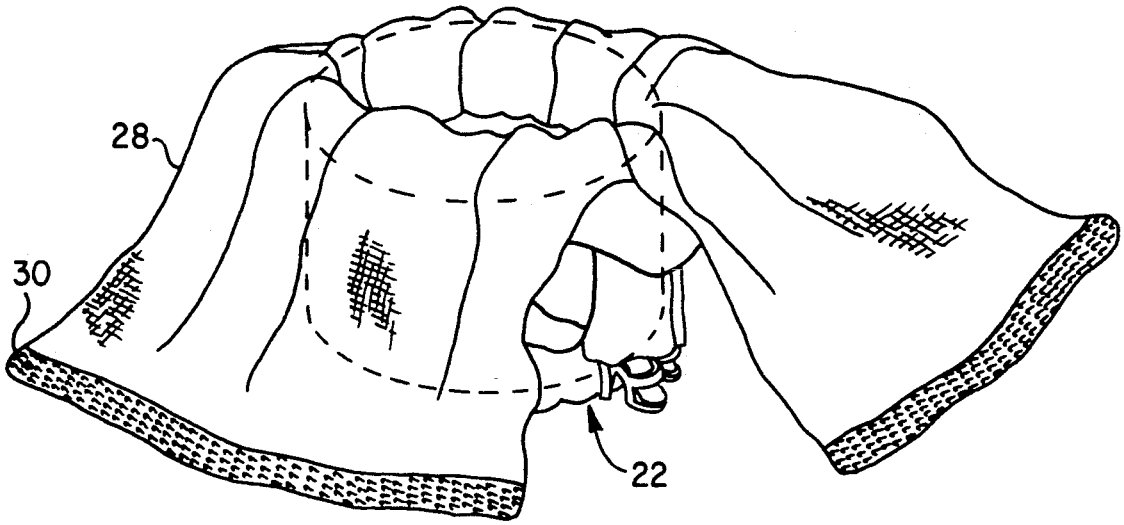

32
10
40
42
42
42
12
49
44
46

TRANSFORMABLE DOLL

TECHNICAL FIELD

The invention generally relates to dolls and, more particularly, to a doll that can be transformed between two characters or persona.

BACKGROUND AND SUMMARY

Perhaps the most common toy of children is the doll. Dolls have represented a virtually endless variety of real and imaginary animals, characters and people, bringing to life the dreams of children. It is not surprising, then, that children often like best dolls that bring to life fantasy or story book characters, such as Cinderella, Superman and others, which allow creation of their own story involving a favorite hero or heroine.

A number of characters portrayed by dolls are transformed between two, and sometimes more, personalities or likenesses in their story-book or fantasy lives. For example, Cinderella's rag clothes are instantly transformed into a beautiful gown by her fairy Godmother. Many other examples can be given, such as the evil queen who disguised herself as an old woman in order to trick Snow White and the Little Mermaid who was transformed into a princess by the wicked Sea Witch.

Unfortunately, dolls previously available have not been capable of recreating such transformations made by the characters they represent. Typically, dolls require a complete change of costume, a task very much unlike the magical change often undergone in the character's fantasy story. One construction interconnects only the pre- and post-transformation torso, arms and heads of the character. Such a doll lacks a lower body, and must be held by the body-half representing the character's persona not in use by the child. Consequently, such dolls can be used only as hand-held puppets, lacking realism.

The present invention is a doll capable of realistically portraying different characters or persona of a character, while overcoming the foregoing limitations and disadvantages. The doll has a body portion representing the upper body of at least two characters or persona to be portrayed. The upper body of each character or persona are interconnected and extend in opposite directions from each other. A removable support engages one end of the body portion, and represents the lower portion of the character or persona represented by the other end of the doll. The support both engages and conceals the body portion not in use. At the same time, the support gives the illusion of the lower portion of the unconcealed character or persona portrayed by the body portion in use. Thus the entire character or persona can be portrayed.

In yet another aspect of the invention, the support can be secured to and released from the upper body portion, to allow easy transformation of the doll between the two characters or persona.

In still another aspect of the invention, a second support is used to represent the lower portion of the second character or persona portrayed by the doll.

In a further aspect of the invention, one or more supports are used, each representing a vehicle, animal or other thing related to the doll character or persona portrayed.

BRIEF DESCRIPTION OF THE DRAWINGS

For a more complete understanding of the present invention and the advantages thereof, reference is now made to the following description taken in conjunction with the accompany drawings in which:

FIG. 4 is a perspective view of a doll incorporating a first embodiment of the invention, showing insertion of the body portions of the doll into a first support to portray the first character;

DETAILED DESCRIPTION

Figure 1:
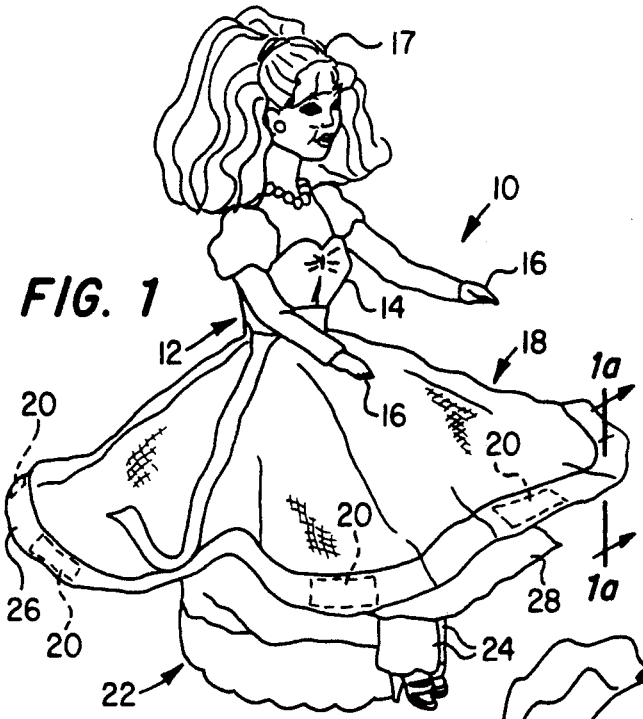
FIG. 1 is a perspective view of a doll incorporating a first embodiment of the invention, shown as a first character.

Referring now to FIG. 1, shown is a doll 10 comprising a first embodiment of the invention, assembled to represent a princess, or first character. It will be apparent that the present invention is capable of portraying two different characters or two different persona of a single character. An example of a single character having two persona is Cinderella, who in one persona is dressed in rags and in her other persona is beautifully dressed in a ball gown. To simplify the discussion of the invention, the term "character" shall refer to a persona of a single character, such as Cinderella, as well as to separate story-book fantasy or real-life animals, supernatural beings, individuals, etc.

The doll 10 includes a first body portion 12 that represents the upper body of a princess. The first body portion includes a torso 14, arms 16, and a head 17. The first body portion 12 is given the appearance of a princess, merely as an example. It will be apparent that other characters, whether human, animal, supernatural or otherwise, could be portrayed by the first body portion.

The first body portion 12 is clothed with a gown 18 having a skirt extending downwardly about the lower end of the doll 10. Secured about the perimeter of the outside surface of the skirt of the gown 18 are Velcro® fastening strips 20. The fastening strips 20 are identified by broken lines in FIG. 1. The strips 20 may be secured to the gown 18 by stitching, gluing or other suitable means.

The doll 10 is supported by a support 22, representing generally the lower half of the princess portrayed as the first character by the doll 10. The support 22 is a molded plastic, cylindrical container which holds a second body portion (not shown in FIG. 1) of the doll 10 when not in use. Secured to the exterior of the support 22 are a pair of doll legs 24, representing the legs of the portrayed princess. Secured to the support 22 are a pair of underskirts 26 and 28, which extend outwardly, as does the skirt of the gown 18. The underskirt 26 extends outwardly from the support 22 beyond the lower edge of the gown 18, allowing the underskirt 28 to be folded over and secured to the fastening strips 20 spaced about the lower edge of the gown 18.

Figure 1A:
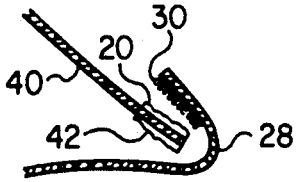
FIG. 1*a* is a partial section view taken along lines 1*a*—1*a* of FIG. 1.

As is shown best in the partial section view of FIG. 1*a*, taken along section lines 1*a*—1*a* in FIG. 1, the underskirt 26 includes a Velcro® fastening strip 30 that mates with and secures to the Velcro® fastening strips 20 of the gown 18. The fastening strip 30 of the support 22 extends continuously about the perimeter of the underskirt 26, to facilitate mating with the fastening strips 20 of the gown 18. Alternately, a series of Velcro® fastening strips could be used in place of the single, continuous fastening strip 30, in which case alignment of strips 20 and 30 would be required during assembly.

The perimeter of the underskirt 26 is folded over and secured to the lower edge of the gown 18 by engagement of the fastening strips 20 and 30. The underskirt 26 thus obscures from view the upper end of the support 22 and the inside or reverse surface of the gown 18.

Figure 2:
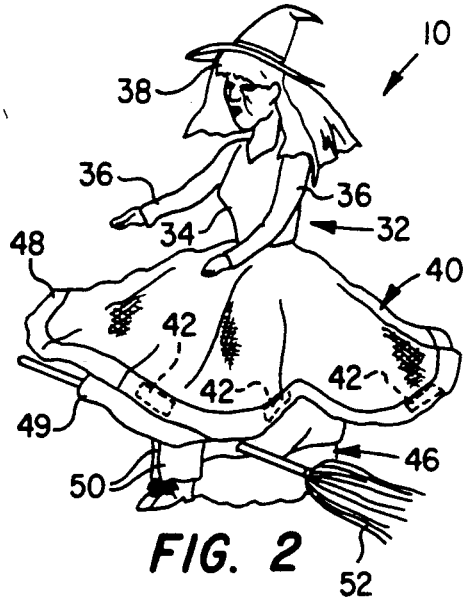
FIG. 2 is a perspective view of a doll incorporating a first embodiment of the invention, shown as a second character.

Shown in FIG. 2 is the doll 10 portraying a witch as a second character. Assembled as the witch, the doll 10 includes a second body portion 32, with a torso 34, arms 36, and a head 38. The second body portion 32 is cloaked with a witch dress 40, extending outwardly and downwardly from the torso 34. The skirt of the dress 40 is the reverse side of the princess gown 18, turned inside-out. Secured to and spaced about the lower perimeter of the witch dress 40 are a number of Velcro® fastening strips 42.

The lower portion of the witch character is represented by a support 46. The support 46 is a molded plastic, cylindrical container, which receives and conceals the first body portion 12 representing the princess character. Thus, when portrayal of the princess character by the doll 10 is not desired, the first body portion 12 is inserted into the support 46, as shown in FIG. 2. Secured to the exterior of the support 46 are a pair doll legs 50 and a broom 52. Together, the legs 50 and broom 52 give the doll 10 of FIG. 2 the appearance of a witch riding on a broomstick.

Secured to and extending outwardly from the support 46 is an underskirt 48. Secured to the support 46 below the underskirt 48 is a second underskirt 49. The underskirt 48 includes a single, continuous Velcro® fastening strip (shown in FIG. 5) secured about the perimeter of the underskirt 42 similarly to the fastening strip 30 of the support 22 of FIG. 1. The fastening strip 44 of the underskirt 48 secures to the Velcro® fastening strips 42 of the witch dress 40.

To secure the underskirt 48 to the support 46, the perimeter of the underskirt 48 is folded over the lower perimeter of the witch dress 40, in a manner similar to underskirt 26, shown in FIGS. 1 and 1*a*. The Velcro® fastening strip 44 of the underskirt is then secured to the Velcro® fastening strips 42 of the witch dress 40. The underskirt 48 thus serves to both secure the support 46 to the witch dress 40 and to conceal the underside of the witch dress 40 from view. The reverse side of the witch dress 40, of course, represents the princess gown 18.

Figure 3:
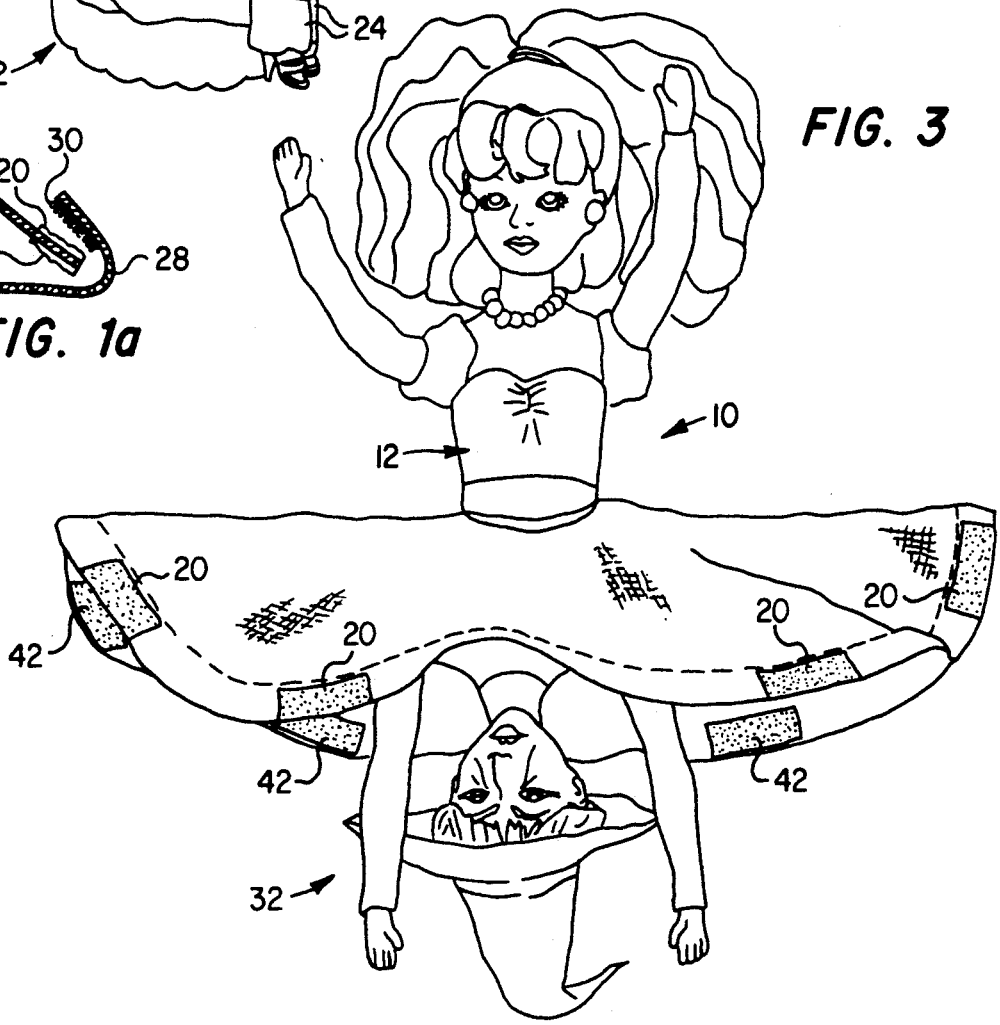
FIG. 3 is a side view of the body portions of a doll incorporating the first embodiment of the invention.

FIG. 3 illustrates the interconnection of the first and second body portions 12 and 32, respectively of the doll 10. The first and second body portions 12 and 32 are manufactured conventionally, from molded plastic, and are preferably secured together at their intersection by gluing. However, it will be apparent that other suitable means of interconnecting the first body portions 12 and 32 may be used such as an integral construction from a single mold, use of a mechanical fastener, and thermal welding.

FIG. 4 illustrates assembly of the doll 10 to portray the princess character. The skirt of the gown 18 and the underskirt 26 are shown partially cut away to better illustrate the second body portion 32 and the support 22, respectively. The second body portion 32 representing the witch is first inserted into the open end of the support 22. The support 22 has sufficient depth to receive substantially the entire second body portion 32, representing the witch. The gown 18 and the underskirt 26 are then secured together, in the manner shown in FIG. 1*a*. The resulting assembly appears as shown in FIG. 1.

Figure 5:
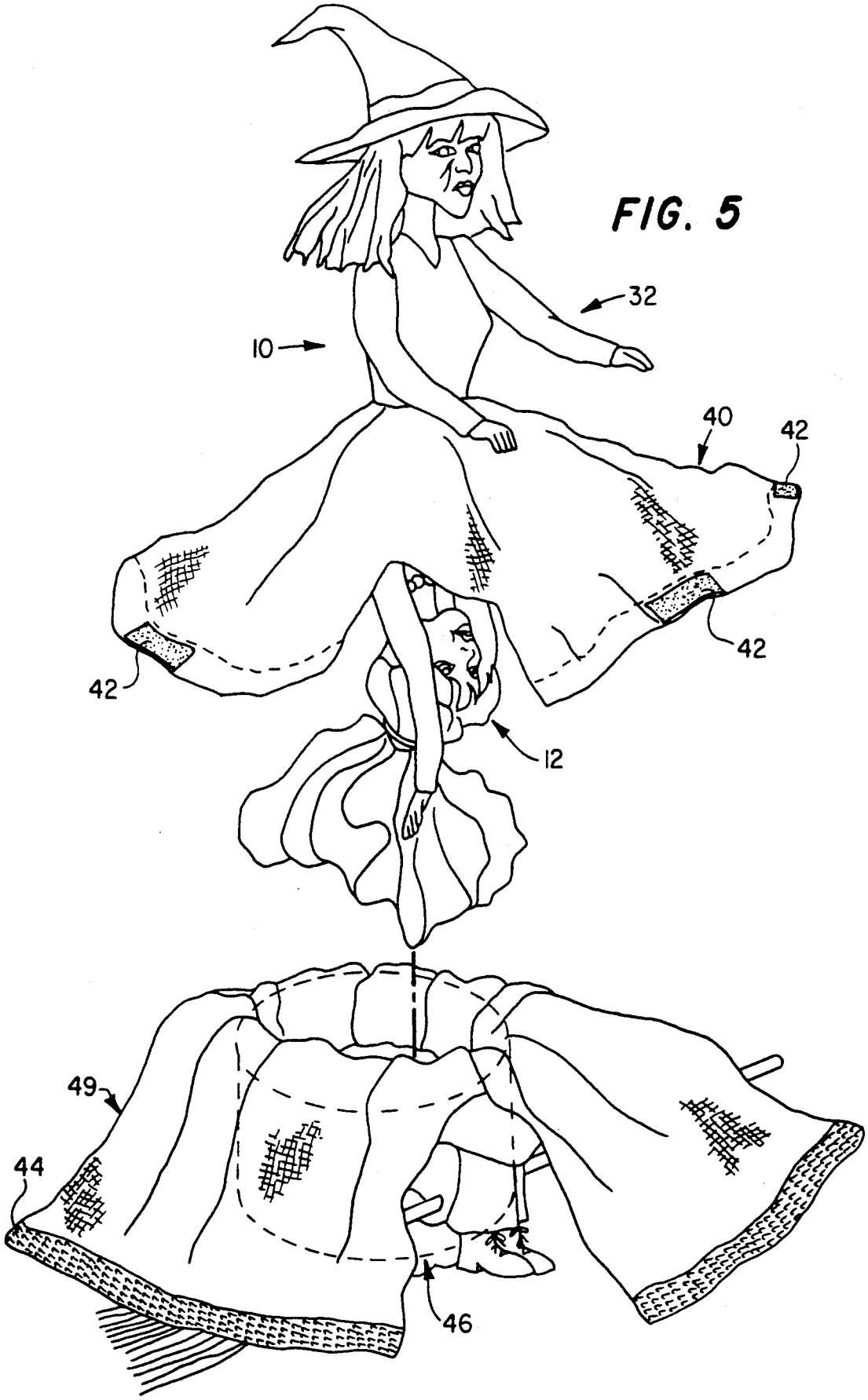
FIG. 5 is a perspective view of a doll incorporating a first embodiment of the invention, showing insertion of the body portions of the doll into a second support to portray the second character.

A similar method of assembling the doll 10 as a witch is depicted in FIG. 5. The skirt of the witch dress 40 and the underskirt 48 are shown partially cut away to better illustrate the first body portion 12 and the support 46, respectively. The first body portion 12 is inserted into the support 46. The support 46 has sufficient depth to receive substantially the entire second body portion 32. The witch dress 40 is next secured to the underskirt 48, by securing the Velcro® fastening strips 42 and 44, in the manner described in connection with FIG. 1*a*. The resulting assembly depicts the witch shown in FIG. 2.

While the embodiment shown in FIGS. 1 through 5 utilize supports 22 and 46 to represent the lower body portions of the princess and witch characters portrayed by the doll 10, other configurations of support structure or stands can be used to both conceal the character not in use and to represent another aspect of the character being portrayed at the time.

Figure 6:
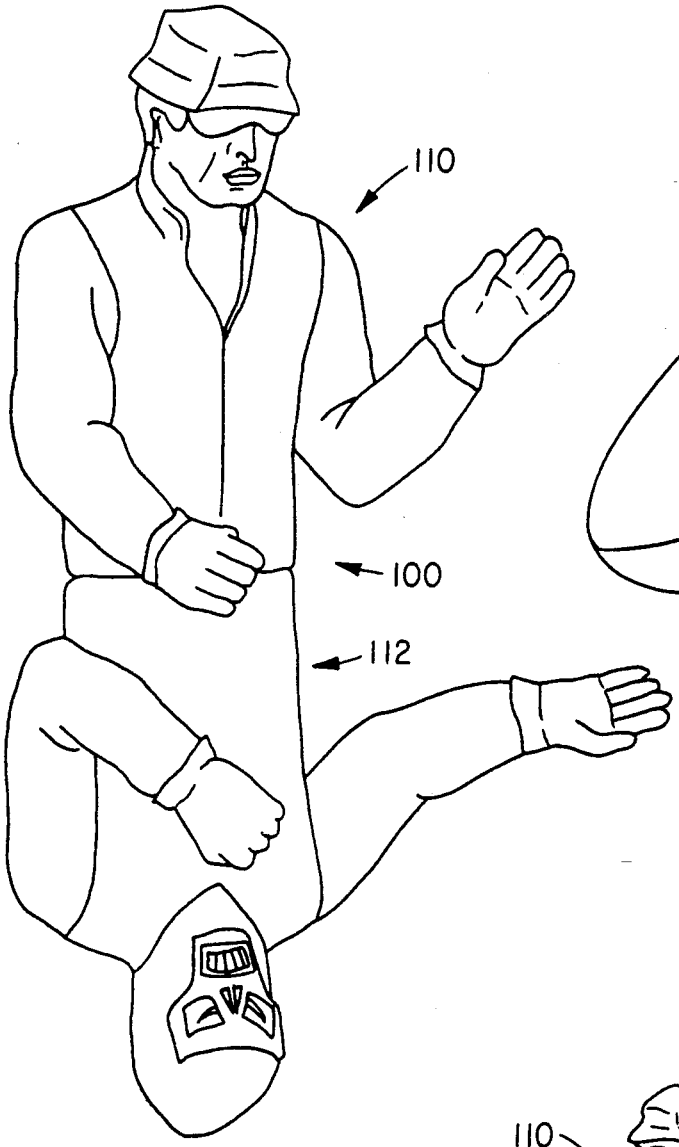
FIG. 6 is a side view of the body portions of a doll incorporating a second embodiment of the invention.
Figure 7:
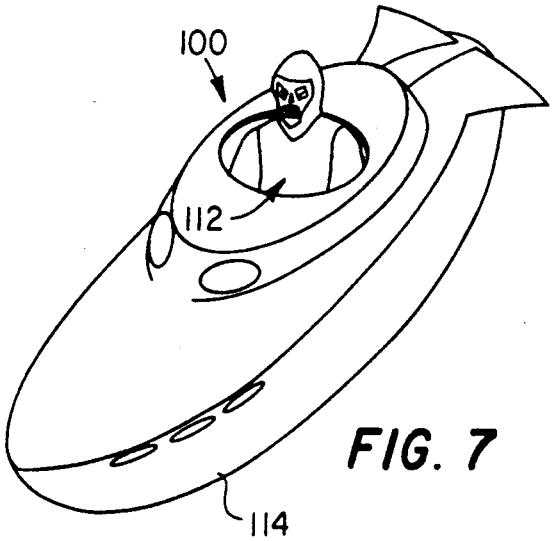
FIG. 7 is a perspective view of a doll incorporating a second embodiment of the invention, portraying a first character.
Figure 8:
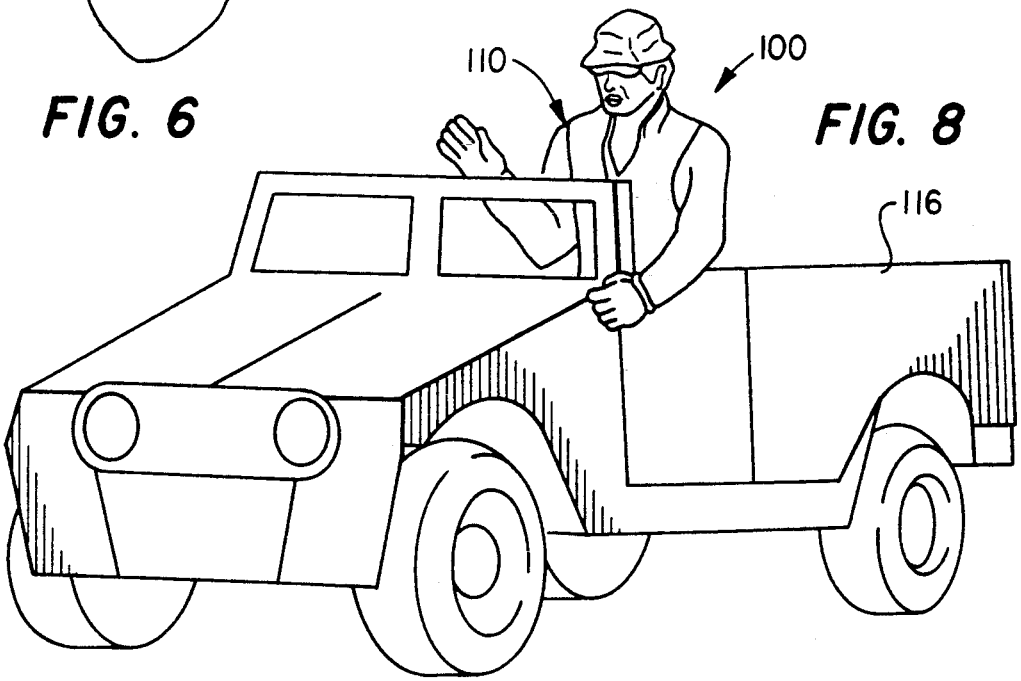
FIG. 8 is a perspective view of the doll incorporating the second embodiment of the invention, portraying a second character.

For example, FIGS. 6, 7 and 8 illustrate a doll 100, comprising a second embodiment of the invention wherein supports both conceal the unused character and represent a vehicle driven by the portrayed character. The doll 100 includes a first body portion 110, which represents a hero, for example. A second body portion 112 of the doll 100 represents a villain, or other adversary of the hero. The body portions 110 and 112 are preferably manufactured and secured together similarly to the body portions 12 and 32 of the doll 10 depicted in FIGS. 1 through 5.

FIG. 7 illustrates the assembly of the doll 100 to portray a villain character operating a spaceship support 114. The spaceship support 114 provides a function similar to that of the supports 22 and 46 of FIGS. 1 through 5, of supporting the doll 100 and concealing the first body portion 110 of the doll, when not in use. In addition, the spaceship support 114 represents a vehicle flown by the second body portion 112, and gives the strong illusion that the villain depicted has a complete lower body.

The spaceship support 114 is preferably manufactured of molded plastic; however, other suitable materials can be used effectively. While the doll 100 incorporates a spaceship support 114, it will be apparent that representations of other vehicles, animals or other related objects or beings might be used instead.

FIG. 8 illustrates the doll 100 as a hero driving a truck support 116. The truck support 116 provides a function similar to that of the spaceship support 114, of supporting the doll 100 and concealing the second body portion 112, when not in use. The truck support 116 is preferably manufactured of molded plastic; however, other suitable materials can be used effectively. While the doll 100 incorporates a truck support 116, it will be apparent that representations of other vehicles, animals or other related objects or beings might be used instead.

Further, it will be apparent that the doll 110 can be assembled in a configuration wherein the first body portion 110 representing the hero extends from the spaceship support 114, if desired. The doll 100 might alternatively be assembled in a configuration wherein the second body portion 112 representing the villain extends from the truck support 116. Moreover, the doll 100 can be assembled with a virtually unlimited variations of supports representing trucks, animals, and other related objects and beings.

Only the preferred embodiments of the invention have been described. It should be understood that the invention is not limited to the embodiments disclosed, but is intended to embrace any alternatives, modifications, rearrangements, or substitutions of parts or elements as fall within the spirit and scope of the invention.

We claim:

1. A doll transformable between at least a first and a second character, comprising:

a first body portion representing the upper body of the first character;

a second body portion representing the upper body of the second character;

the first and second body portions secured together and extending in substantially opposite directions from their point of interconnection;

first detachable support means for supporting the first and second body portions with the first body portion extending away from the detachable support means and for concealing the second body portion from view;

a skirt attached at the point of interconnection of the first and second body portions for concealing non-selected body parts, having an upper surface conforming in appearance to the first body portion of the first character and a lower surface conforming in appearance to the second body portion of the second character; and fastening means on both the upper and lower surface of the skirt for securing and releasing the selected detachable support means from the selected body portion.

2. The doll of claim 1 wherein the first detachable support means includes a container for receiving the second body portion.

3. The doll of claim 1 wherein the first detachable support means includes design characteristics conforming in appearance to the first body portion of the first character.

4. The doll of claim 1 further comprising a second detachable support mans for supporting the first and second body portions with the second body portion extending away from the second support means and for concealing the first body portion from view.

5. The doll of claim 4 wherein the second detachable support means includes design characteristics conforming in appearance to the second body portion of the second character.

6. The doll of claim 5 wherein the second support means includes a container for receiving the first body portion.

7. A doll interchangeable between at least two characters, comprising:

an upper module including the upper body portions of first and second characters extending in substantially opposite directions from an area near the waist of each character; and a lower module which can be secured to the upper module, comprising:

a support for supporting the upper module with the upper body portion of one of the first and second characters extending from the support; and a lower body portion of one of the first and second characters secured to the support.

8. The doll of claim 7 wherein when the support supports the upper module, substantially the entire body of the first or second character is represented.

9. The doll of claim 7 further including at least one skirt secured to the support, the skirt having fastening means for attachment of the skirt to the upper module.

10. The doll of claim 9 wherein the support of the lower module comprises a container for receiving and supporting the upper module and for concealing one of the first and second characters represented by the upper module.

11. The doll of claim 10 wherein the lower body portion is secured to the exterior of the container.

12. The doll of claim 11 further comprising fastening means for releasably securing the container to the upper module.

* * * * *